US006846245B2

(12) United States Patent
Baron

(10) Patent No.: US 6,846,245 B2
(45) Date of Patent: Jan. 25, 2005

(54) GOLF PUTTER

(76) Inventor: George Alfred Baron, 8000 Baymeadows Cir. East #97, Jacksonville, FL (US) 32256

( * ) Notice: Subject to any disclaimer, the term of this patent is extended or adjusted under 35 U.S.C. 154(b) by 0 days.

(21) Appl. No.: 10/400,258

(22) Filed: Mar. 27, 2003

(65) Prior Publication Data

US 2003/0186756 A1 Oct. 2, 2003

Related U.S. Application Data

(60) Provisional application No. 60/367,982, filed on Mar. 28, 2002.

(51) Int. Cl.[7] ..... A63B 53/06
(52) U.S. Cl. ..... 473/252
(58) Field of Search ..... 473/252, 253, 473/254, 345

(56) References Cited

U.S. PATENT DOCUMENTS 4,136,877 A * 1/1979 Antonious ..... 473/254
4,629,193 A * 12/1986 Pierman ..... 473/254
D296,120 S * 6/1988 Brace ..... D21/739
4,995,612 A * 2/1991 Finney ..... 473/341
5,248,145 A * 9/1993 Brown ..... 473/254
5,921,868 A * 7/1999 DiMartino ..... 473/254
6,267,689 B1 * 7/2001 Ambrose ..... 473/251
6,379,259 B1 * 4/2002 Opie ..... 473/251
6,394,910 B1 * 5/2002 McCarthy ..... 473/251

OTHER PUBLICATIONS

TRAXX Golf web site pages, pp. 1–3 dated Jan. 19, 2003.

* cited by examiner

*Primary Examiner*—Gregory Vidovich
*Assistant Examiner*—Nini F. Legesse
(74) *Attorney, Agent, or Firm*—Thomas C. Saitta

(57) ABSTRACT

A golf putter having a pair of parallel linear edge members disposed on its top surface separated by a top surface opening and a pair of parallel linear indicator members disposed on the upper surface of the sole and visible to the golfer through said top surface opening, whereby visual alignment of said linear edge members with said linear indicator members indicates to the golfer that the putter head is properly positioned and that the golfer's eyes are vertically disposed above target putting line.

10 Claims, 5 Drawing Sheets

GOLF PUTTER

This application claims the benefit of U.S. Provisional Patent Application Ser. No. 60/367,982, filed Mar. 28, 2002.

BACKGROUND OF THE INVENTION

This invention relates generally to the field of golf clubs, and more particularly to golf putters. Even more particularly, the invention relates to golf putters having alignment means to visually indicate to the golfer proper use, positioning and/or alignment of the putter.

In the game of golf, putting is a crucial skill, since a two-inch tap in resulting from a missed linger putt counts equal to a 300-yard drive. For many golfers, consistent accurate putting is a difficult skill to achieve, as successful putting requires first the ability to read the green to judge line and speed, and second the ability to translate a proper read into a putt with the proper line and speed. The mechanics of putting include the factors of stance, alignment and stroke. The golfer should adopt and maintain a stance such that the golfer's eyes are disposed directly above the ball. The stance should not be too upright or too distant. The putter head should be level and properly aligned as to the intended putting line.

The problem of how to teach and how to consistently repeat the basic putting stroke is as old as the game of golf itself. Many teachers and inventors have tried numerous methods through literature, training aids, direct coaching and club design—all with varying degrees of success. Certain attempted solutions possess inherent weaknesses. Reading and studying how to properly putt require the ability of the golfer to properly translate the words into action. Direct coaching through lessons happen apart from the actual playing of the game, and the golfer must be able to replicate the instructions without the aid of the watchful eyes of the teacher. Training devices cannot be used on the course, and often involve complicated or gimmicky apparatuses.

Thus the best approach lies in the development of an actual golf putter that provides an indication to the golfer of proper use during the actual use of the club while playing the game. With golf putters, this is typically addressed by providing visual indicators on the club head itself of various construction, wherein the visual indicators provide information to the golfer to verify that a certain aspect of putting is being correctly applied. Usually the indicators address the issue of target alignment of the putter face to the intended putting line, such that the golfer knows that the putter face is set perpendicularly to the putting line. Often this entails the placement of a single line perpendicular to the putter face and centered on the sweet spot or face balance point, the line being placed on the top side or on a rearward extending flange such that it is visible from above. Another recent innovation has been to provide two golf ball sized white circles aligned perpendicularly to the putter face. While these visual indicators provide information as to the alignment of the club relative to the putting line, they fail to provide information on whether the putter head is positioned in a level manner, i.e., such that the club is horizontally disposed in the heel-to-toe direction, or on whether the golfer's eyes are properly disposed directly above the ball during the putting stroke. In addition, the commonly used visual indicators are generally distracting, as they remain visually dominant even when the club is properly positioned. Furthermore, the commonly used visual indicators do not take into account that many golfers, especially seniors, suffer from weak eyesight, such that discerning proper alignment of a single thin line, for example, is a difficult task. This excessive concentration on the line or other visual indicator is actually detrimental to good putting, since the golfer needs to concentrate on the line and stroke.

It is an object of this invention to provide a golf club putter that addresses the problems and issues described above, in a manner that overcomes the shortcomings of the known putters. These and other objects are addressed by providing a putter having visual indicator or alignment means that are formed as structural components of the club head itself, and in particular in a manner whereby the visual alignment means are visually dominant only when the putter is incorrectly positioned or the golfer is in an incorrect stance. When the golfer and putter head is correctly positioned, the visual alignment means become less visually dominant, such that they do not distract from concentration on the putting stroke. A further object is to provide such a putter wherein the alignment means are structured such that they are readily seen and properly interpreted even by golfers with poor eyesight. A further object is to provide such a putter wherein the overall shape and configuration of the putter head is variable to the preference of individual golfers, and wherein the shaft length, lie angle and other factors may be varied to fit a particular golfer. A further object is to provide for alignment means having a variety of structures, wherein all the various structures retain common elements whereby upper alignment means comprising a pair of parallel, linear edge members defining a top surface opening are disposed in combination with lower alignment means comprising a pair of parallel, linear members, such that proper alignment and position of both the golfer and the putter head result in visual alignment of the lower members and the upper members, while misalignment of either the golfer or the putter results in one of the lower alignment members being visible to the golfer between the upper members.

SUMMARY OF THE INVENTION

The invention is a golf club putter that provides a visual indication to the golfer that the putter face is properly aligned relative to the target putting line, that the putter head is disposed in a level manner in the heel-to-toe direction, and that the golfer is in the proper putting stance with the golfer's eyes positioned directly above the ball. The putter is generally configured in any of a large number of known and popular configurations for putters, and comprises generally a head mounted to a shaft, the head comprising a face, toe, heel, sole or flange, and a top surface, wherein the structures define a cavity.

The putter further comprises visual indicator means comprising upper alignment means and lower alignment means. The upper alignment means comprise a pair of parallel, linear edge members extending perpendicularly to and in the direction rearward from the putter face and disposed in the top surface of the putter head, with the two linear edge members defining a top surface opening to the cavity such that the upper surface of the sole or bottom flange is visible to the golfer from above. The lower alignment means comprise a pair of parallel, linear indicator members extending perpendicularly to and in the direction rearward from the putter face and disposed on the upper surface of the sole or flange, with the two linear indicator members dividing the sole upper surface into a central portion, a toe portion and a heel portion. The distance between the linear indicator members is generally equal to the distance between the linear edge members, and the two sets of parallel members are disposed such that, when the putter head is disposed in a level or horizontal orientation, the heel-side linear indicator member is vertically below the heel-side linear edge member and the toe-side linear indicator is vertically below the toe-side linear edge member. The internal cavity of the putter head extends beyond the linear indicator members in both the heel and the toe direction.

The linear indicator members disposed on the upper surface of the sole or bottom flange preferably comprise physical or structural features, such as ridges, grooves or shoulders, but may also comprise painted or imprinted indicia that serve to define and distinguish the central portion of the sole upper surface from the heel and toe portions. In this manner, when the putter is properly disposed relative to true horizontal and when the golfer's eyes are positioned directly above the ball, the heel-side linear indicator member will align with the heel-side linear edge member and the toe-side linear indicator member will align with the toe-side linear edge member, such that the features will become less visible and virtually disappear. On the other hand, if the heel of the club is improperly raised, the golfer's stance is too upright or too far away from the ball, the toe-side linear indicator member and some of the toe portion of the sole upper surface will be visible in the top surface opening between the linear edge members, thereby providing an easily seen visual indication that corrections are needed. Likewise, if the toe of the club is improperly raised, the golfer's stance is too slumped or too close to the ball, the heel-side linear indicator member and some of the heel portion of the sole upper surface will be visible in the top surface opening between the linear edge members.

DETAILED DESCRIPTION OF THE INVENTION

With reference to the drawings, the invention will now be described in detail with regard for the best mode and the preferred embodiment. In general, the invention is a golf club putter, a putter being a specialized club with a generally vertically oriented face such that a golf ball when struck by the club is propelled along the putting surface of the green rather than lofted into the air. It is to be understood that the drawings illustrate only one of a multitude of possible choices for the general overall size, shape and configuration of the putter head and shaft, and it is emphasized that the novel and inventive elements described herein may be applied to putters of different size, shape and configuration without departing from the spirit and efficacy of the invention. By way of example, the invention may also comprise a mallet-type putter configuration, or a putter with an offset shaft, a putter with or without perimeter weighting, etc. Also in general, the invention is a golf club putter that provides a visual indication to the golfer that the putter face is properly aligned relative to the target putting line, that the putter head is disposed in a level manner in the heel-to-toe direction, and that the golfer is in the proper putting stance with the golfer's eyes positioned directly above the ball.

Figure 1:
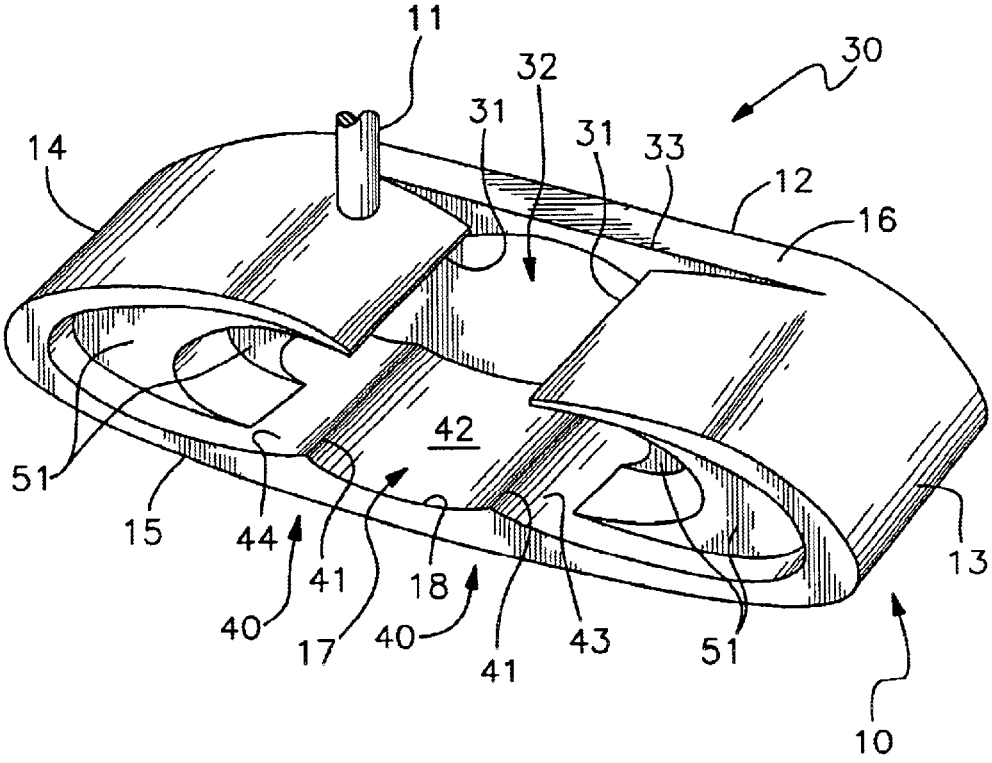
FIG. 1 is a perspective view of the invention.
Figure 3:
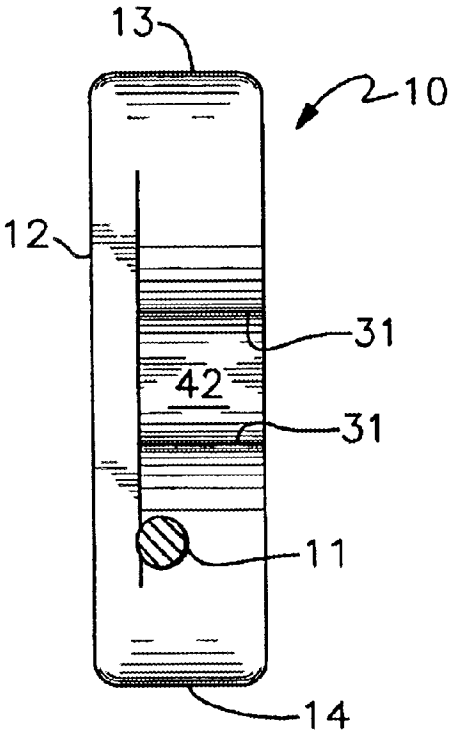
FIG. 3 is a top view of the invention with the alignment means showing correct positioning of the club head.
Figure 2:
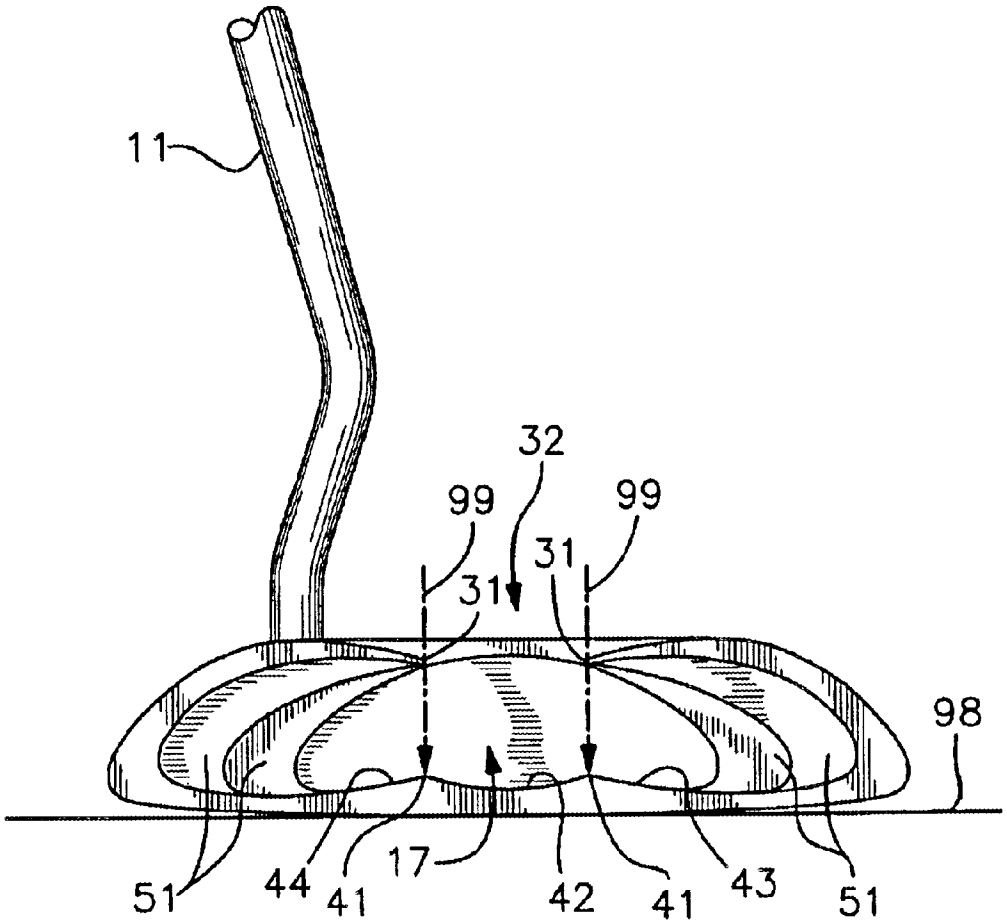
FIG. 2 is a rear view of the invention showing correct positioning of the club head.

As shown in FIGS. 1 through 3, the invention is a golf club putter comprising a putter head 10 connected in known manner to a golf club shaft 11. The particular configuration of the shaft 11 and the location of its connection to the putter head 10 can be varied. The putter head 10 comprises in standard manner a face 12 for striking the golf ball, a toe 13 at the distal end away from the golfer, a heel 14 at the proximal end nearest the golfer, a sole or bottom flange 15 as the lowermost element, and a top surface 16. The putter head 10 is of sufficient depth such that an internal cavity 17 is provided and defined by the face 12, toe 13, heel 14, sole 15 and top surface 16, with the cavity 17 preferably being open to the rear of the club. The bottom of the cavity 17 is defined by the sole upper surface 18. Preferably, the putter head 10 is provided with structural elements of varying height, width or depth positioned toward or comprising the toe 13 and the heel 14 to create a perimeter weighting effect, shown in the figures as offset bodies 51, such that balls struck off center on the club face 12 are less likely to result in torqueing or twisting of the club, a concept well known in the art. The head 10 and shaft 11 may be composed of any material suitable for its intended purpose, such as metals, ceramics, polymers, or composites or combinations of these materials. The head 10 may be forged, machined or created by any other suitable technique known in the art. Preferably the head 10 is face-balanced.

The putter head 10 further comprises upper alignment means 30 and lower alignment means 40. It is the combination of upper alignment means 30 and lower alignment means 40 that provides the visual information to the golfer that the club head 10 is properly positioned and that the golfer is in the proper stance, or conversely that the club head 10 is improperly positioned and that the golfer is in an improper stance. The upper alignment means 30 comprises a pair of parallel, linear edge members 31 which together define a top surface opening 32 into the cavity 17, the solid top surface 16 of the head 10 being removed between the linear edge members 31. The linear edge members 31 extend rearward from behind the face 12, centered about the optimum ball striking point on the face 12 (i.e., the heel-to-toe center of gravity such that no twist is imparted when the ball is struck at this point), and are essentially perpendicular to the face 12 (the face 12 may have a slightly convex configuration on some putters). The linear edge members 31 are not only parallel to each other, they are parallel to the optimum swing path of the putter. As shown in the figures, the top surface 16 is preferably sloped downward in the direction of each of the linear edge members 31 in order to better delineate the linear edge members 31 relative to the face 12 by creating a linear rail member 33 parallel to the face 12, which provides a better reference for aligning the face 12 perpendicularly to the target putting line. The linear edge members 31 are preferably radiused or beveled to increase visibility by providing a slight change in shading or tone due to changes in the angle of reflected light, but such that the linear edge members 31 do not dramatically stand out so as to be distracting to the golfer. Thus it is less preferable that the linear edge members 31 be colored or imprinted.

The top surface opening 32 provides a window into the cavity 17 such that the sole or bottom flange upper surface 18 is visible to the golfer from above, thereby exposing lower alignment means 40. Lower alignment means 40 comprises a pair of parallel, linear indicator members 41. As with the linear edge members 31, the linear indicator members 41 extend rearward from behind the face 12, centered about the optimum ball striking point on the face 12, and are essentially perpendicular to the face 12. The linear indicator members 41 are only parallel to each other, are parallel to the linear edge members 31, and are parallel to the optimum swing path of the putter. Most preferably, the distance in the heel-to-toe direction between the pair of linear edge members 31 is equal to the distance between the pair of linear indicator members 41, although the latter distance may be slightly greater to account for the slight angular dispersion in the sight line from the golfer's eyes to the linear indicator members 41.

The linear indicator members 41 are most preferably actual physical or structural elements extending above, extending below or forming the sole upper surface 18, and act to divide the sole upper surface 18 into three component portions—a central portion 42, a toe portion 43 and a heel portion 44. The internal cavity 17 extends a greater distance in the heel-to-toe direction than the distance between the linear edge members 31 and linear indicator members, such that a portion of the sole upper surface 18 outside of the linear indicator members 41, either the toe portion 43 or the heel portion 44, will be visible when the putter head 10 or the golfer's stance is not properly positioned.

In the most preferred embodiment as shown in FIGS. 1 through 3, the linear indicator members 41 are raised elements or ridges with the sole upper surface 18 sloping away to either side of each linear indicator member 41, preferably in a curved manner. Thus both toe portion 43 and heel portion 44 of sole upper surface 18 will slope downwardly away from their respective linear indicator members 41, while central portion 42 will have a slight concave shape resulting from the inwardly sloping surfaces. Linear indicator members 41 are most preferably angular in heel-to-toe cross-section, such that the lines of demarcation between the central portion 42 and the toe portion 43 and heel portion 44 are readily visible.

Figure 5:
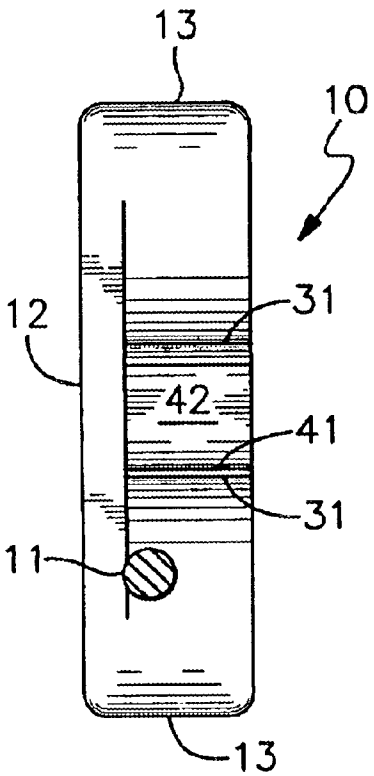
FIG. 5 is a top view of the invention with the alignment means showing incorrect positioning of the club head, such that the toe is raised.
Figure 4:
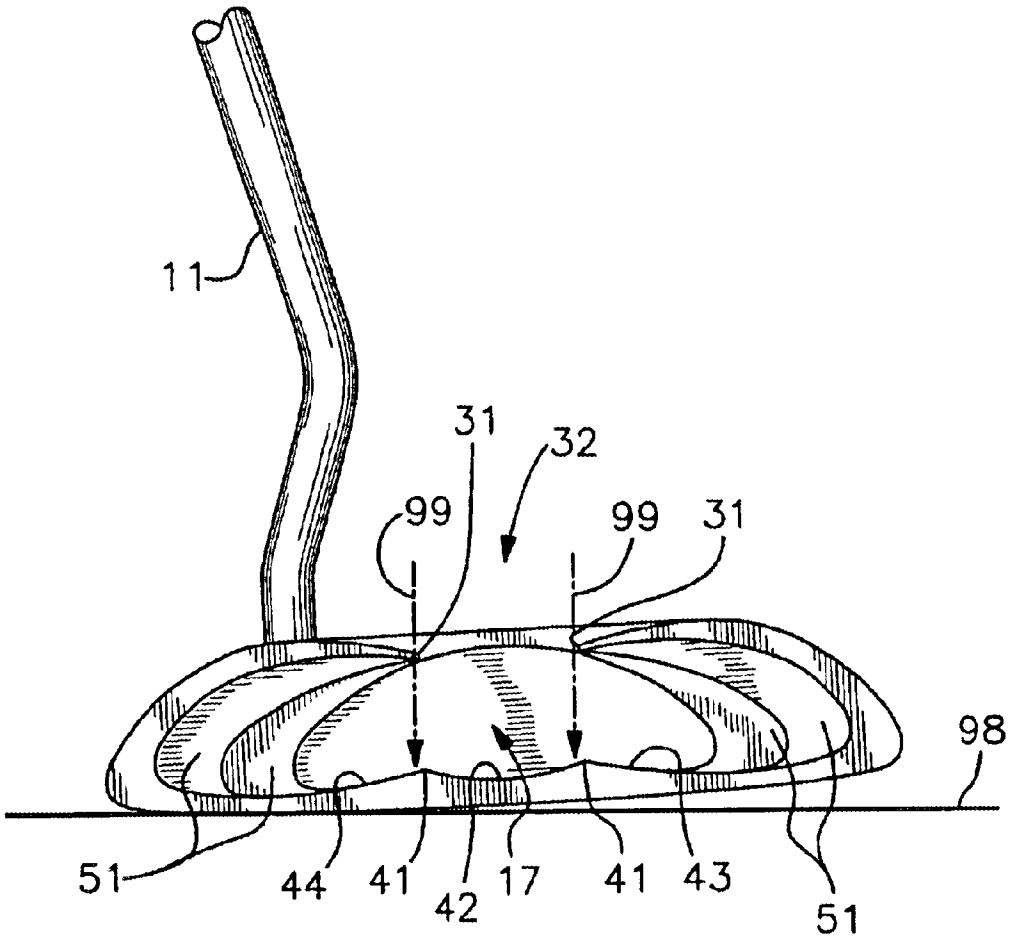
FIG. 4 is a rear view of the invention showing incorrect positioning of the club head, such that the toe is raised.
Figure 7:
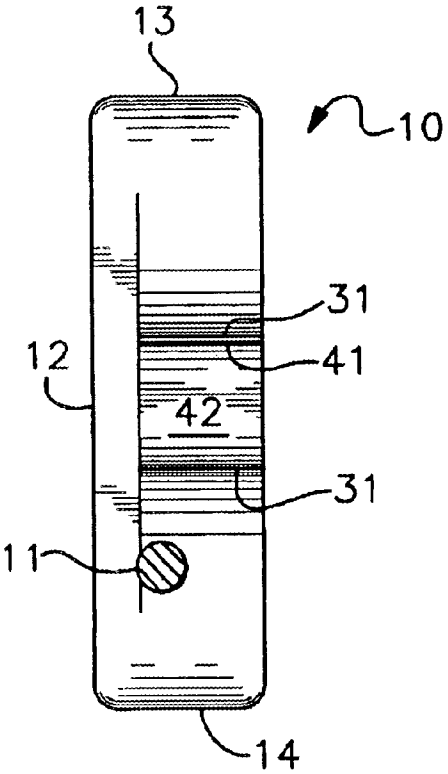
FIG. 7 is a top view of the invention with the alignment means showing incorrect positioning of the club head, such that the heel is raised.
Figure 6:
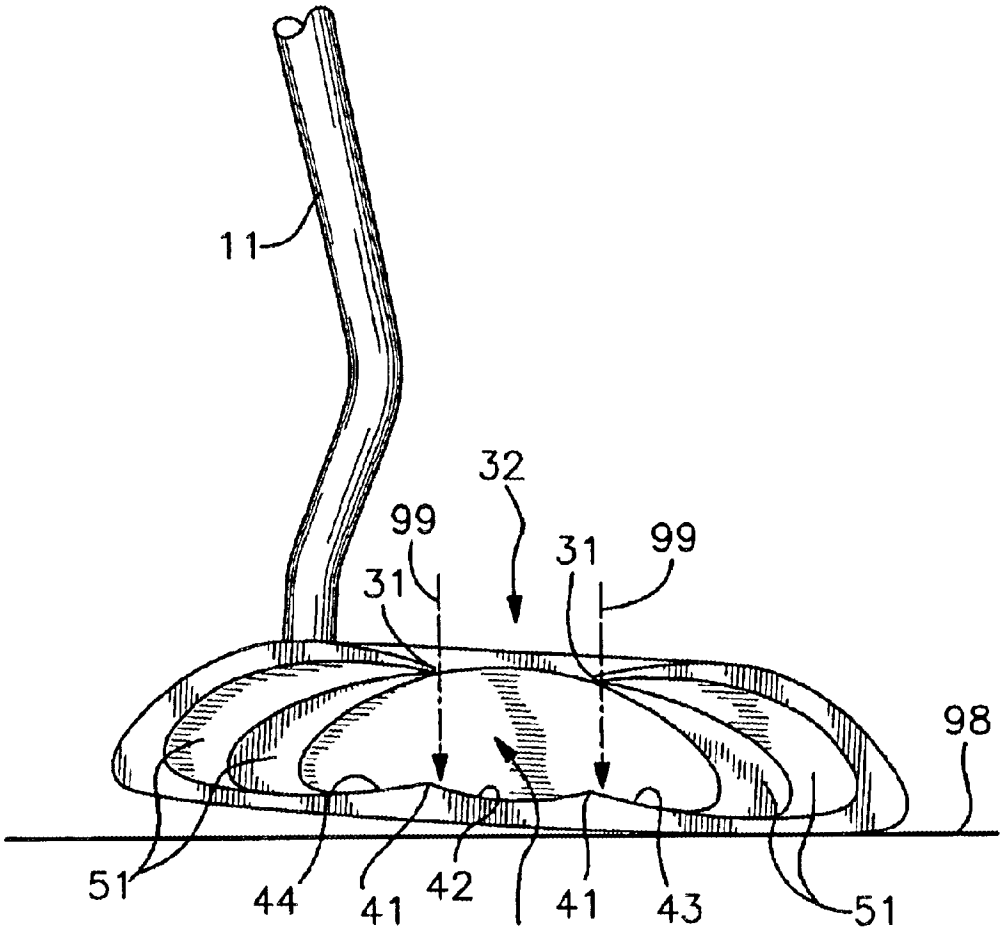
FIG. 6 is a rear view of the invention showing incorrect positioning of the club head, such that the heel is raised.

The operation of the invention is demonstrated by comparison of FIGS. 2 and 3 with the FIGS. 4 and 5 and with FIGS. 6 and 7. FIG. 2 illustrates the head 10 properly disposed in a level or horizontal orientation relative to artificial horizontal line 98. Vertical sight lines 99, perpendicular to horizontal line 98, illustrate the sight line of the golfer when the golfer's eyes are positioned directly above the golf ball on the optimum target line of the club. The pair of linear edge members 31 disposed on the top surface 16 of the head 10 are vertically aligned with the pair of linear indicator members 41 on the sole upper surface 18. The view presented to the golfer is shown in FIG. 3. In looking through the top surface opening 32 between the linear edge members 31, the linear indicator members 41 are obscured by the linear edge members 31 and only the central portion 42 of the sole upper surface 18 is seen. There are no distracting elements presented to the golfer, yet the golfer is informed that the club head 10 is level, that the eyes are disposed properly and that the stance is proper.

FIGS. 4 and 5, in contrast, illustrate the circumstance where proper position is not present. As illustrated in FIG. 4, the toe 13 of the putter head 10 is improperly raised above the horizontal line 98. Thus the vertical sight lines 99 tangential to the linear edge members 31 are shifted in the heel direction and the heel-side linear indicator member 41 and a small portion of the heel portion 44 of the sole upper surface 18 is visible between the linear edge members 31, as shown in FIG. 5. This same visual indication would be presented to the golfer if the stance is too slumped or too close to the ball, such that the eyes are disposed beyond the optimum target line. The golfer now knows to undertake corrective measures prior to striking the golf ball.

FIGS. 6 and 7 illustrate another circumstance where position is not proper. In this circumstance, the heel 14 of the putter head 10 is improperly raised above the horizontal line 98. The vertical sight lines 99 tangential to the linear edge members 31 are now shifted in the toe direction and the toe-side indictor member 41 and a small portion of the toe portion 43 of the sole upper surface 18 is visible between the linear edge members 31, as shown in FIG. 7. The same visual indication will be presented to the golfer if the stance is too upright or too far from the ball, such that the eyes are disposed in front of the optimum target line.

By forming the linear indicator members 41 as physical features whereby the slopes of the toe portion 43 and heel portion 44 are inclined in opposing manner to the slope of the central portion 42 to the respective sides of the linear indicator members 41, advantage is taken of the change in the angle of reflectance from the adjoining surfaces. The central portion 43 will capture and reflect more ambient light back to the golfer through the top surface opening 32 than will either the toe portion 43 or the heel portion 44. Thus the central portion 43 will present itself as brighter than either the toe portion 43 or the heel portion 44. This serves to present a clear indication to the golfer as to whether the linear edge members 31 and linear indictor members 41 are properly aligned without the need for artificially distracting components, since the change in brightness will be easily apparent when either the toe portion 43 or the heel portion 44 is exposed to view.

Figure 8:
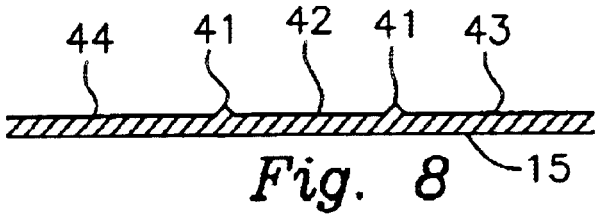
FIGS. 8 through 12 are partial, cross-sectional views showing alternate embodiments for the lower alignment means.
Figure 9:
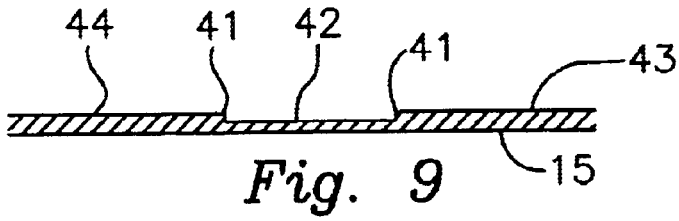
Figure 10:
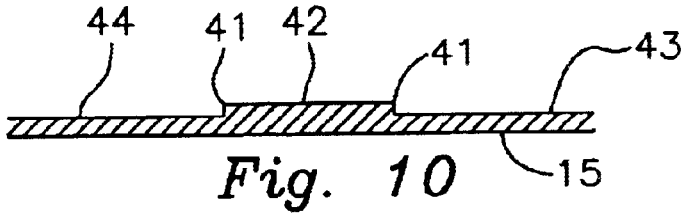
Figure 11:
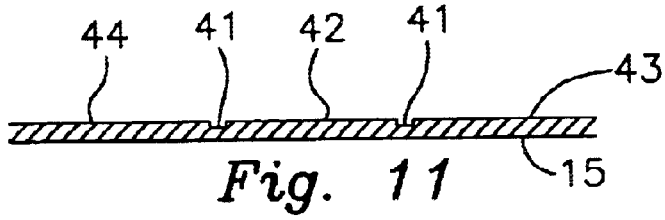
Figure 12:
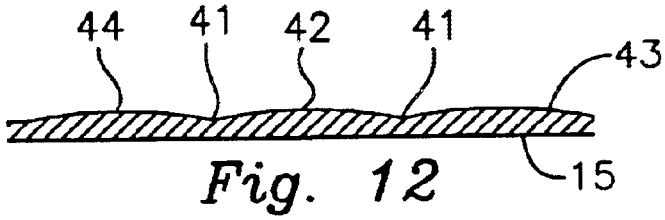

It is to be understood however that other physical structures may be provided for the linear indicator members 41 on the sole upper surface 18. FIGS. 8 through 12 illustrate representative alternate embodiments. In FIG. 8 the sole upper surface is 18 is generally planar with two angular ridges forming linear indicator members 41. In FIG. 9 the central portion 42 is recessed and in FIG. 10 the central portion is raised, such that shoulders define the linear indicator members 41. In FIG. 11 grooves are disposed in the sole upper surface 18 to define the linear indicator members 41. In FIG. 12, the central portion 42, toe portion 43 and heel portion 44 are convexly configured such that the valley junctions define the linear indicator members 41. A multitude of similar yet alternate embodiments combining physical structural elements, planar slopes, convex curves, concave curves, etc. are also envisioned, provided that each such embodiment results in a pair of linear indicator members 41 defining a central portion 42, toe portion 43 and heel portion 44 visible between and aligned relative to the linear edge members 31 as described above.

Figure 13:
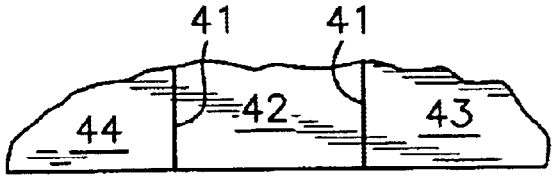
FIG. 13 is a partial top view showing another alternate embodiment for the lower alignment means.

Although much less desirable, an embodiment is also contemplated wherein the linear indicator members 41 comprise lines painted or imprinted onto the sole upper surface, as shown in FIG. 13. The central portion 42, toe portion 43 and heel portion 44 may be provided as different colors, or the surfaces may be distinguished by polishing, roughening, embossing or similar means.

It is understood that equivalents and substitutions to certain elements and components set forth above may be obvious to those skilled in the art, and thus the true scope and definition of the invention is to be as set forth in the following claims.

I claim:

1. A golf putter comprising a putter head comprising a face for striking a golf ball, a toe, a heel, a sole, a sole upper surface, a top surface, and a cavity;

upper alignment means comprising a pair of parallel linear edge members;

lower alignment means comprising a pair of parallel linear indicator members, wherein said linear indicator members are ridges and divide said sole upper surface into a heel portion, a central portion and a toe portion, and wherein said central portion has a concave shape and wherein said toe portion and said heel portion slope away from said linear indicator members;

wherein the combination of said upper alignment means and said lower alignment means provides a visual indication that said putter head is properly positioned in a level manner.

2. The putter of claim 1, wherein said upper alignment means are disposed on said top surface such that a top surface opening is defined between said linear edge members.

3. The putter of claim 2, wherein said sole upper surface is visible through said top surface opening.

4. The putter of claim 3, wherein the distance between said linear edge members is equal to the distance between said linear indicator members.

5. The putter of claim 4, wherein said linear edge members and said linear indicator members are perpendicular to said face.

6. The putter of claim 5, wherein said linear indicator members are physical structures defining said sole upper surface.

7. A golf putter for indicating to a golfer that said putter is properly positioned and that said golfer's eyes are properly positioned above said putter, comprising a putter head comprising a face for striking a golf ball, a toe, a heel, a sole, a sole upper surface, a top surface, and a cavity;

upper alignment means disposed on said top surface and comprising a pair of parallel linear edge members and a top surface opening between said linear edge members;

lower alignment means disposed on said sole upper surface and comprising a pair of parallel linear indicator members separated a distance equal to the distance separating said linear edge members, wherein said linear indicator members divide said sole upper surface into a central portion, a toe portion and a heel portion, and wherein said linear indicator members, said central portion, said toe portion and said heel portion are visible through said top surface opening and said cavity;

wherein said linear indicator members are ridges and wherein said central portion has a concave shape and wherein said toe portion and said heel portion slope away from said linear indicator members;

wherein the combination of said upper alignment means and said lower alignment means provides a visual indication that said putter head is properly positioned in a level manner and that said golfer's eyes are properly positioned, in that when properly positioned only said central portion is visible to said golfer through said top surface opening, whereas when improperly positioned one of said pair of linear indicator lines is visible to said golfer through said top surface opening.

8. The putter of claim 7, wherein said linear edge members and said linear indicator members are perpendicular to said face.

9. The putter of claim 8, wherein said linear indicator members are physical structures defining said sole upper surface.

10. A golf putter for indicating to a golfer that said putter is properly positioned in a level manner and that said golfer's eyes are properly positioned vertically above said putter along a target putting line, comprising a putter head comprising a face for striking a golf ball, a toe, a heel, a sole, a sole upper surface, a top surface, and a cavity;

upper alignment means disposed on said top surface and comprising a pair of parallel linear edge members extending rearward and a top surface opening between said linear edge members;

lower alignment means disposed on said sole upper surface and visible through said top surface opening and said cavity, comprising a pair of parallel linear indicator members extending rearward separated a distance equal to the distance separating said linear edge members, wherein said linear indicator members are ridges and divide said sole upper surface into a concave central portion, a toe portion sloping away from said linear indicator members and a heel portion sloping away from said linear indicator members;

wherein the combination of said upper alignment means and said lower alignment means provides a visual indication that said putter head is properly positioned in a level manner and that said golfer's eyes are properly positioned, in that when properly positioned only said central portion is visible to said golfer through said top surface opening, whereas when improperly positioned one of said pair of linear indicator lines is visible to said golfer through said top surface opening.

* * * * *